United States Patent [19]

Adam

[11] 4,222,316

[45] Sep. 16, 1980

[54] ROOM CONDITIONING LAMP

[75] Inventor: Jakob Adam, Giessen, Fed. Rep. of Germany

[73] Assignee: Siemens Aktiengesellschaft, Berlin and Munich, Fed. Rep. of Germany

[21] Appl. No.: 851,988

[22] Filed: Nov. 16, 1977

Related U.S. Application Data

[63] Continuation of Ser. No. 650,700, Jan. 20, 1976, abandoned.

[30] Foreign Application Priority Data

Jan. 23, 1975 [DE] Fed. Rep. of Germany ..... 2502538

[51] Int. Cl.[2] ..... F24F 7/06

[52] U.S. Cl. ..... 98/40 DL; 98/40 N

[58] Field of Search ..... 98/40 DL, 40 N; 240/9 R, 9 A

[56] References Cited

U.S. PATENT DOCUMENTS

| | | | |
|---|---|---|---|
| 2,519,503 | 8/1950 | Rigaumont | 98/40 DL |
| 3,004,142 | 10/1961 | Archer | 240/9 A |
| 3,101,038 | 8/1963 | Archer | 98/40 DL |
| 3,114,505 | 12/1963 | Kennedy | 98/40 DL |
| 3,403,614 | 10/1968 | Carnes | 98/40 DL |
| 3,424,233 | 1/1969 | Meckler | 98/40 DL |
| 3,838,268 | 9/1974 | Fabbri | 98/40 DL |
| 3,945,306 | 3/1976 | Brown | 98/40 DL |

FOREIGN PATENT DOCUMENTS

| | | | |
|---|---|---|---|
| 2,312,716 | 9/1974 | Fed. Rep. of Germany | 98/40 DL |

*Primary Examiner*—Henry C. Yuen

*Attorney, Agent, or Firm*—Kenyon & Kenyon

[57] ABSTRACT

A room conditioning lamp is disclosed, in which a nozzle arrangement is provided along the walls of the open lamp chamber for blowing a supply of air into the room to be conditioned. Exhaust air openings are also situated in a region of each wall along which no supply air is conducted. By changing the supply air stream and/or the underpressure in the exhaust air system, the ratio of discharged to recirculated room air can be changed.

7 Claims, 5 Drawing Figures

ROOM CONDITIONING LAMP

This is a continuation of application Ser. No. 650,700, filed Jan. 20, 1976, now abandoned.

BACKGROUND OF THE INVENTION

1. Field of the Invention

The invention relates to a room conditioning lamp having a lamp housing which includes a lamp chamber in which at least one lamp is situated. More particularly, it relates to a lamp of the aforesaid type which further includes a supply air guide for coupling supply air between a supply air inlet and a supply air outlet, the supply air absorbing lamp heat on the way, and at least one exhaust air opening which is in connection with the lamp chamber.

2. Description of the Prior Art

A room conditioning lamp of the described type is disclosed in German Offenlegungsschrift 2,312,716. In the latter lamp, the heat generated by the lamp and possibly by series-connected equipment is used in part for heating the cool fresh air supplied to the room. To accomplish this, a substream of the fresh supply air which can be controlled as a function of the room temperature, is conducted through a chamber which is completely separated from the light emission aperture and through the exhaust air opening and is then admixed again with the other separated substream.

In addition to being expensive, the aforesaid lamp has the disadvantage that only an unsatisfactorily small portion of the total heat generated by the lamp can be used for room conditioning. Moreover, the failure to return sufficient amounts of the heat being generated by the lamp to the room can be detrimental to the light yield.

It is, therefore an object of the present invention to provide a room conditioning lamp designed in such a manner that a variable portion of the lamp heat can be coupled into the room to be conditioned and into the exhaust air opening.

SUMMARY OF THE INVENTION

The above and other objectives are accomplished in accordance with the principles of the present invention in a room conditioning lamp of the above-described type by additionally including therein a nozzle arrangement adjacent the wall of the lamp housing and parallel to the longitudinal direction of the lamp. This nozzle arrangement directs fresh supply air into the housing such that it is conducted along the wall of the housing, through the lamp chamber and out of the light emission aperture.

Due to the so-called Koanda effect, the aforesaid fresh air, flowing along the walls of the housing carries with it the heated stagnant air in the lamp chamber. This stagnant air thus also passes out of the lamp chamber through the light emission aperture and into the room to be conditioned. Within certain limits, the amount of stagnant air carried by the supply air increases with the flow velocity of the supply air, so that the room temperature can be controlled by changing the amount of supply air being fed by the nozzle arrangement. On the other hand, the exhaust air which is also loaded with lamp heat and is fed into the exhaust air stream, decrease with increased supply air flow and/or increase underpressure of the exhaust air system.

The supply air will, as a rule, be purified fresh air; however, it can also be taken directly from the room to be conditioned or from the exhause air system which, for example, may take the form of a false-floor space which is kept at underpressure.

The nozzle arrangement may comprise several plates arranged in side-by-side relationship along the longitudinal direction of the room conditioning lamp. Preferably, however, it if formed by a continuous baffle plate and by a part of the wall of the housing, the baffle plate being shaped and directed so that the supply air stream is blown along the wall, essentially transversely to the longitudinal axis of the lamp housing. As above-indicated, the supply air flows along the wall of the housing, which wall may be in the form of a reflector, and leaves the lamp primarily at the edges of the light emission apertures. In order to facilitate the flow of the warm stagnant air along with the fresh air, it is advisable to design the curvature of the walls of the housing to be as smooth as possible. Additionally, care must be taken to ensure effective removal of exhaust air, particularly if no fresh air is to be supplied to the room. It has been found to be particularly advantageous to arrange each exhaust air opening within an end face of a longitudinal side of the housing such that at least 50% of the cross section area of the opening is below the horizontal plane going through the center of the lamp.

If the exhaust air openings are arranged in the end faces and if it is desired to have a certain amount of exhaust air flow in the presence of the supply air flow, then it is advisable to terminate the nozzle formed by baffle plate before it reaches the end faces containing the exhaust air opening. Preferably the distance between the plate and end faces should not exceed $\frac{1}{4}$ of the lamp length. It is also advantageous, when it is desired to couple lamp heat as completely as possible into the room to be conditioned, to make the supply air guidance in the vicinity of the baffle plates such that the flow of the supply air through the light emission aperture is strongest next to an exhause air opening.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
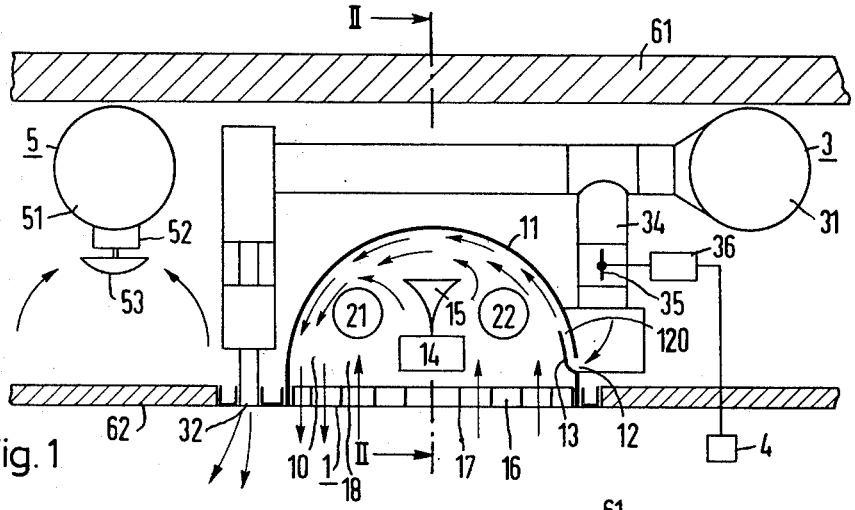
FIG. 1 shows a cross section through a room conditioning lamp in accordance with the principles of the present invention.
Figure 2:
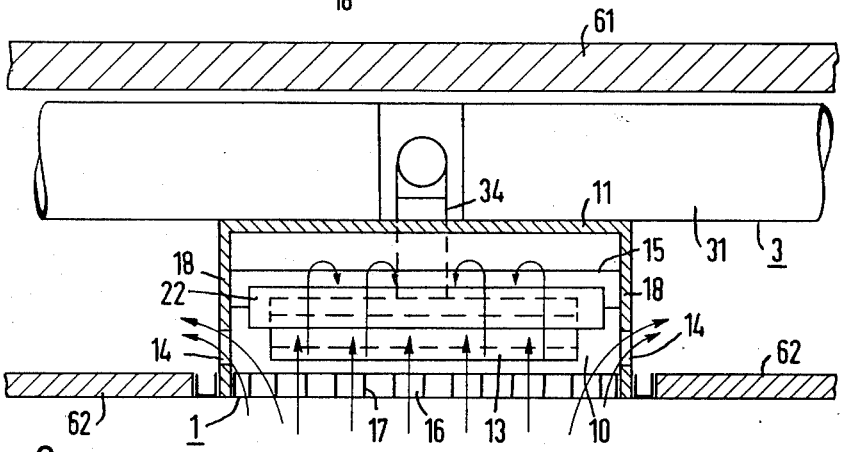
FIG. 2 illustrates a longitudinal cross section of the lamp of FIG. 1 taken along the line II—II in FIG. 1.
Figure 3:
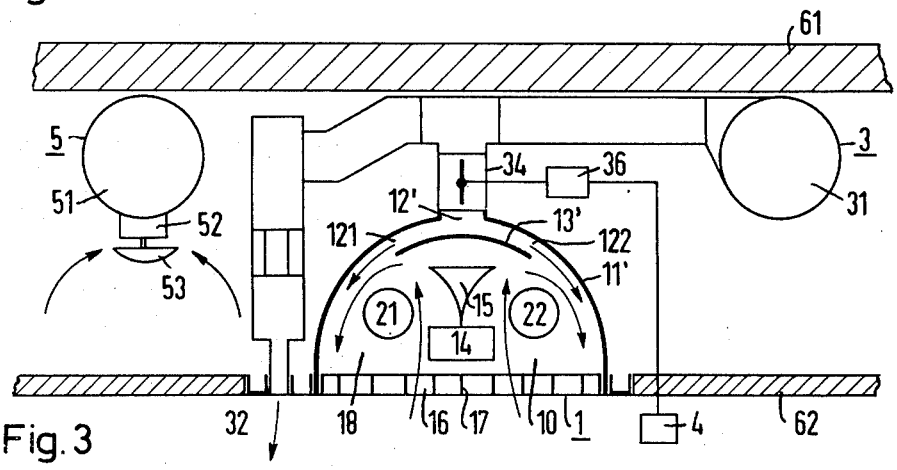
FIG. 3 shows a cross section of a second embodiment of a room conditioning lamp in accordance with the invention.

FIGS. 1 and 2 show a first embodiment and FIG. 3 a second embodiment of a room conditioning lamp 1 in accordance with the principles of the present invention. The lamp 1 includes a concave housing 11 which is designed as a reflector. Preferably the housing 11 has the shape of a conic section, particularly a circular or parabolic conic section. The housing also has an open light emission aperture 16 in which a grid 17 is located. In the lamp chamber formed by the housing 11 and the grid 17 are arranged two lamps 21, 22 and, between them, a V-shaped central web 15 which hides the series-connected equipments. In each of the opposing end walls 18, a rectangular exhaust air opening 14 is arranged centrally between the lamps 21 and 22 and below the horizontal plane going through their centers. Each lamp is installed in a false ceiling 62, which is suspended from a solid ceiling 61.

In the space between the ceilings 61 and 62 are a supply air system 3 and an exhaust air system 5. The supply air system 3 comprises a main duct 31 to which is connected an air outlet 32 associated with the room conditioning lamp 1. The main duct 31 is also connected to the lamp 1 itself via a branch duct 34 having a control flap 35 arranged therein. The exhaust air system 5, in turn, includes a main duct 51 which has exhaust air pipes 52 which open into the space between the two ceilings and the air stream of which can be adjusted by means of a disc valve 53. The air system 51 generates underpressure between the ceilings and thereby draws off room air through the exhaust air openings 14 of the room conditioning lamp 1.

In the embodiment of the invention according to FIGS. 1 and 2, a supply air inlet 12 and a baffle plate 13, which is located within the housing 11 and forms the nozzle arrangement 120, are situated in the lower third of the housing in the vicinity of a lateral long edge of the light emission aperture 16. With the control flap 35 open, a stream of fresh supply air flows, as indicated by the arrows, along the wall of the housing 11 and enters into the room to be conditioned along the long edge opposite the inlet opening 12. Due to the so-called Koanda effect, the aforesaid supply air carries with it the stagnant warm air around the lamps 21, 22, so that room air is "sucked in" to the lamp 1. The aforesaid stream of fresh supply air conducted through the room conditioning lamp 1 can be reduced by a controller 36 and the control flap 35 as a function of a room thermostate 4. Such reduction, in turn, will be accomplished by an increase in the room air portion drawn off into the exhaust air system 5 via the exhause air openings 14. In this manner, local temperature variations can be equalized in a room without an additional after-heater and with only one supply air duct.

The embodiment of the invention shown in FIG. 3 differs from the above-described embodiment of FIGS. 1 and 2 only in that the inlet opening 12' and the baffle plate 13' are arranged in the center of the housing 11'. In particular, these elements are arranged symmetrically relative to the central vertical plane, so that two nozzles 121, 122 pointing in opposite directions are formed. Accordingly, the fresh supply air flowing from the duct 34, which is now arranged above the aperture 12', is divided into two substreams which enter the room to be conditioned through opposite long edges of the aperture 16. Operation of the embodiment of FIG 3 is, in principle, similar to operation of the embodiment of FIGS 1 and 2, except that mixed air flows out of lamp 1 through aperture 16 along the aforesaid long edges and room air flows into lamp 1 through aperture 16 along its central portion.

Figure 4:
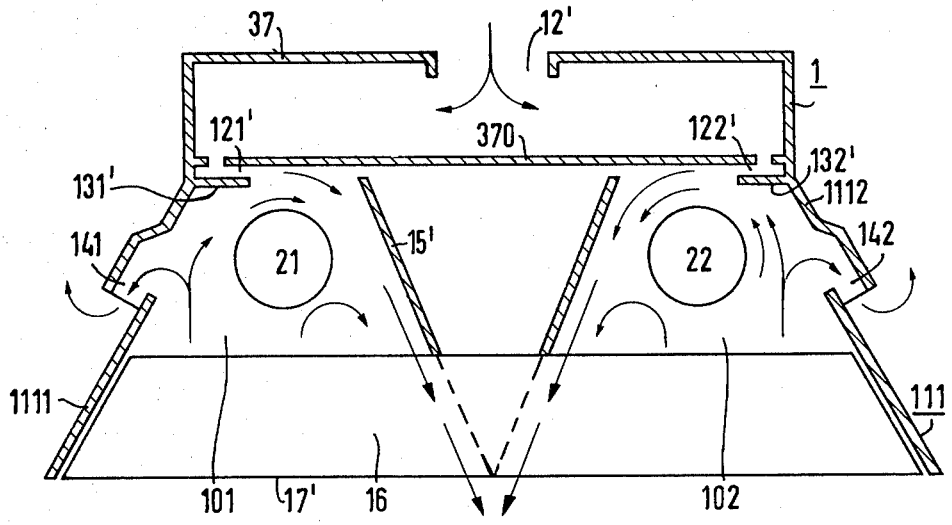
FIGS. 4 and 5 illustrate cross sections through two further embodiments of room conditioning lamps in accordance with the invention.
Figure 5:
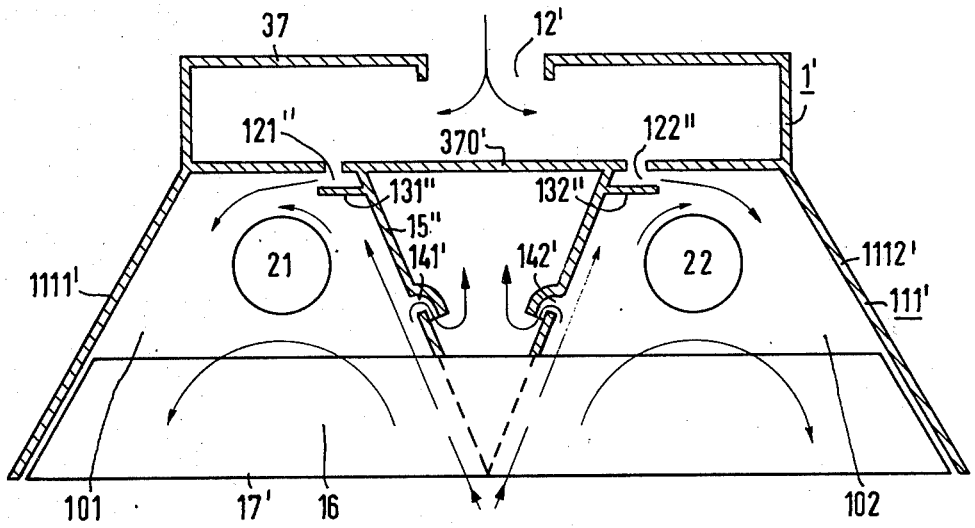

In the embodiments of the invention shown in FIGS. 4 and 5, a room conditioning lamp 1' is shown which comprises two aerodynamically separated lamp chambers 101, 102 formed by a V-shaped central web. More particularly, in FIG. 4, the two lamp chambers 101, 102 house the two lamps 21,22, respectively, and are defined by the V-shaped central web 15' and by the outer parts 1111 and 1112 of the housing 111. The central web 15', which usually hides the series-connected equipment, includes a grid 17' which is arranged inside a light emission aperture 16 in a conventional manner.

A supply air inlet 12' is situated in a box-like upper part 37 which serves to distribute the supply air. The upper part 37 is closed off at the bottom by a flat roof part 370 in which openings leading to the lamp chambers 101, 102 are situated. Below these openings, baffle plates 131', 132' are arranged in such a way that elongated nozzles 121', 122' pointing toward the center web 15' are created. These nozzles do not reach all the way to the vertical center plane between the lamps 21, 22. Due to their presence, an air flow indicated by the arrows is developed.

Exhaust air openings 141, 142 which extend lengthwise are disposed in side-by-side relationship in the two outer parts 1111, 1112 of the housing 111. With these openings, the room air drawn in the room is divided in the manner indicated by the arrows, the ratio depending on the magnitude of the underpressure in the exhaust air system and the strength of the supply air stream.

The embodiment of FIG. 5 is similar to that of FIG. 4, except that the exhaust air openings 141', 142' are arranged in the long sides of the V-shaped central web 15''. This is particularly advantageous if the room conditioning lamp is to be connected to an exhaust air duct, as then the V-shaped central web can serve as an air plenum and be provided with a connecting stub.

As a consequence of the above-described exhaust air path, the two outer parts 1111', 1112' of the housing 111' have no openings. Moreover, the baffle plates 131'', 132'' and the nozzles 121'', 122'' located in the flat roof 370' of the box-like upper part 37' point toward the outer parts 1111', 1112', of the housing and away from the exhaust air openings 141', 142'.

The embodiment of FIG. 5, whose operation is evident from the flow arrows shown, is particularly suitable for use with room conditioning lamps with supply air boxes placed next to them. In particular, very favorable conditions are obtained for the thorough mixing of the air directly conducted into the room via the supply air boxes and the air which is conducted through the room conditioning lamp and is loaded with lamp heat.

In all the above-described embodiments, it is preferable to keep the distance between the lamp and the wall part of the housing located above it equal to or larger than 174 of the lamp diameter.

What is claimed is:

1. A room conditioning apparatus for use with at least one longitudinally extending lamp and with a fresh-air supply, comprising:

a lamp chamber for housing at least one lamp, said lamp chamber being defined by a first wall having longitudinal ends extending parallel to the longitudinally extending lamp and having lateral ends and by second and third walls extending transversely to oppositely disposed longitudinal ends of said first wall and abutting against the lateral ends of said first wall, said first wall extending longitudinally along the length of said lamp when said lamp is housed within said chamber, with only an air space between said first wall and said lamp, said chamber having an open light emission aperture defined by the longitudinal ends of said first wall and by ends of said second and third walls, and at least one exhaust return air opening disposed in one of said second and third walls, for exhausting return air passing from said room into said chamber through said light emission aperture, to a space outside said room; a supply inlet for coupling said supply air to said housing; a nozzle means formed by a baffle plate, spaced from said supply air inlet, and an interior surface of said first wall of said lamp chamber for coupling supply air from said inlet into said chamber along the length of said first wall and for causing said air to be substantially guided along the inside surface of said first wall to one of the longitudinal ends thereof through said chamber, past said lamp and to exit from said chamber through the peripheral portion of said light emission aperture bordered by said one longitudinal end of said first wall, whereby the flow of air along said inside surface will draw additional air from the room through said light emission aperture and past said lamp due to the Coanda effect with a portion of the air flowing through said exhaust return air opening.

2. Apparatus in accordance with claim 1 in which said exhaust air opening is disposed in said second wall such that at least fifty percent of its cross section area is below a horizontal plane passing through said lamp and extending parallel to said light emission aperture.

3. Apparatus in accordance with claim 2 in which said nozzle means is situated above said lamp.

4. Apparatus in accordance with claim 3 in which said first wall includes first and second laterally spaced longitudinally extending wall portions; and said nozzle means comprises a baffle plate which is symmetrically arranged relative to the lateral spacing between said wall portions, said baffle plate forming with said wall portions two nozzles pointing in opposite directions, one nozzle directing air along the inside wall of one wall portion to exit through the peripheral portions of said light emission aperture bordered by said one wall portion and the other directing air along the inside surface of the other wall portion to exit at the peripheral portion of said light emission aperture bordered by said other wall portion.

5. Apparatus in accordance with claim 2 wherein said nozzle means is situated in the lower third of said chamber, bordering one lateral end of said first wall and wherein said nozzle means causes said air to be substantially guided along the inside surface of said first wall to exit at the other lateral end of said first wall.

6. Apparatus in accordance with claim 5 in which said nozzle means is arranged such that the flow of supply air through said light emission aperture is strongest adjacent said exhaust air opening.

7. Apparatus in accordance with claim 6 in which said nozzle means includes a baffle plate which terminates before reaching said second wall.

* * * * *